US011143982B2

(12) United States Patent
Nakase

(10) Patent No.: US 11,143,982 B2
(45) Date of Patent: Oct. 12, 2021

(54) IMAGE FORMING APPARATUS

(71) Applicant: CANON KABUSHIKI KAISHA, Tokyo (JP)

(72) Inventor: Takahiro Nakase, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/891,308

(22) Filed: Jun. 3, 2020

(65) Prior Publication Data

US 2020/0387082 A1 Dec. 10, 2020

(30) Foreign Application Priority Data

Jun. 7, 2019 (JP) ..... JP2019-107292

(51) Int. Cl.
*G03G 15/08* (2006.01)
*G03G 15/00* (2006.01)

(52) U.S. Cl.
CPC ..... *G03G 15/0856* (2013.01); *G03G 15/5016* (2013.01)

(58) Field of Classification Search
CPC ..... G03G 15/0856; G03G 15/556; G03G 21/1889; G03G 15/55; G03G 15/553
See application file for complete search history.

(56) References Cited

U.S. PATENT DOCUMENTS

| | | | | |
|---|---|---|---|---|
| 6,594,451 | B2 | 7/2003 | Kakeshita et al. | |
| 7,068,393 | B2 | 6/2006 | Sasanuma et al. | |
| 2003/0123888 | A1* | 7/2003 | Naito | G03G 15/0856 399/27 |
| 2005/0265738 | A1* | 12/2005 | Ogata | G03G 15/0856 399/27 |
| 2013/0058692 | A1* | 3/2013 | Cheng | G03G 15/55 399/367 |
| 2018/0284646 | A1* | 10/2018 | Suzuki | G03G 15/0862 |
| 2020/0387083 | A1 | 12/2020 | Nakase | |

FOREIGN PATENT DOCUMENTS

| | | | |
|---|---|---|---|
| JP | 2001-175133 | A | 6/2001 |
| JP | 2002-283675 | A | 10/2002 |
| JP | 2003-295595 | A | 10/2003 |
| JP | 2006-259145 | A | 9/2006 |

* cited by examiner

*Primary Examiner* — Walter L Lindsay, Jr.
*Assistant Examiner* — Jessica L Eley
(74) *Attorney, Agent, or Firm* — Venable LLP

(57) ABSTRACT

An image forming apparatus includes an image bearing member, a development cartridge configured to store developer and including a developer bearing member bearing and conveying the stored developer to a position where an electrostatic latent image formed on the image bearing member is developed, a detection unit configured to detect a developer amount within the development cartridge, and a display portion configured to display information indicating that the developer within the development cartridge is insufficient to form an image per size of a recording member, based on a remaining developer amount within the development cartridge detected by the detection unit.

18 Claims, 14 Drawing Sheets

FIG.12A

| MEDIA SIZE | RATE OF REMAINING AMOUNT | STATUS |
|---|---|---|
| A3 | 43% | OK |
| LONG SIZE | 33% | Low! |

57

FIG.12B

A4 | A3 | LONG SIZE

| | RATE OF REMAINING AMOUNT | STATUS | ESTIMATED NUMBER OF SHEETS/DAYS |
|---|---|---|---|
| Y | 33% | Low! | 500 SHEETS/10 DAYS |
| M | 50% | OK | 750 SHEETS/15 DAYS |
| C | 98% | OK | 1450 SHEETS/29 DAYS |
| K | 0% | Out! | 0 SHEETS/0 DAYS |

57

IMAGE FORMING APPARATUS

BACKGROUND OF THE INVENTION

Field of the Invention

The present invention relates to an image forming apparatus.

Description of the Related Art

Because an image forming apparatus consumes developer as the apparatus forms an image, Japanese Patent Application Laid-open No. 2001-175133 proposes a configuration for notifying a user of a remaining developer amount by detecting the remaining developer amount in a cartridge storing the developer.

However, the remaining developer amount that may cause image defects differs depending on a size of a recording member on which an image is to be formed. For instance, even if the remaining developer amount is small, there is a case where a sufficient amount of developer is supplied to a developing roller even if a whole solid image is to be formed without any problem if a size of a recording member in a conveyance direction is short such as an A3-sized sheet, e.g., 420 mm. However, even if the remaining developer amount is the same, developer supplied to the developing roller may be insufficient in a case where an image is to be formed on a long-sized sheet which is long in a rotation direction of a photosensitive drum, e.g., 1200 mm, and the image thus formed may cause blur or voids.

Due to that, if the image forming apparatus displays the remaining developer amount based on the A3-sized sheet, the apparatus may generate image defects before the remaining developer amount becomes 0% in a case where the image is to be formed on the long-sized sheet. Meanwhile, if the image forming apparatus displays the remaining developer amount based on the long-sized sheet, the apparatus may not end up using the developer because replacement of the cartridge is urged even though no image defect occurs by the A3-sized sheet even though the remaining developer amount is 0%. Thus, if the remaining developer amount is set based on one size, a trouble may occur in the other size, and the developer may not be used up properly.

SUMMARY OF THE INVENTION

The present disclosure provides an image forming apparatus that informs a user of whether toner within a development cartridge is insufficient to form an image per size of the recording member, by taking a developer amount within the development cartridge into account.

According to a first aspect of the disclosure, an image forming apparatus configured to form a toner image on a recording member includes an image bearing member, a development cartridge configured to store developer and including a developer bearing member bearing and conveying the stored developer to a position where an electrostatic latent image formed on the image bearing member is developed, a detection unit configured to detect a developer amount within the development cartridge, and a display portion configured to display information indicating that the developer within the development cartridge is insufficient to form an image per size of a recording member, based on a remaining developer amount within the development cartridge detected by the detection unit.

According to a second aspect of the disclosure, an image forming apparatus configured to communicate with an external device and to form a toner image on a recording member includes an image bearing member, a development cartridge configured to store developer and including a developer bearing member bearing and conveying the stored developer toward a position where an electrostatic latent image formed on the image bearing member is developed, a detection unit configured to detect a developer amount within the development cartridge, and a transmission portion configured to transmit information indicating that the developer within the development cartridge is insufficient to form an image per size of the recording member, based on a developer amount within the development cartridge detected by the detection unit to the external device.

The present disclosure also provides an image forming apparatus that informs the user of whether it is necessary to replace the development cartridge to form an image per size of the recording member, by taking a developer amount within the development cartridge into account.

According to a third aspect of the disclosure, an image forming apparatus configured to form a toner image on a recording member includes an image bearing member, a development cartridge configured to store developer and including a developer bearing member bearing and conveying the stored developer to a position where an electrostatic latent image formed on the image bearing member is developed, a detection unit configured to detect a developer amount within the development cartridge, and a display portion configured to display information indicating that it is necessary to replace the development cartridge to form an image per size of a recording member, based on a remaining developer amount within the development cartridge detected by the detection unit.

According to a forth aspect of the disclosure, an image forming apparatus configured to communicate with an external device and to form a toner image on a recording member includes an image bearing member, a development cartridge configured to store developer and including a developer bearing member bearing and conveying the stored developer to a position where an electrostatic latent image formed on the image bearing member is developed, a detection unit configured to detect a developer amount within the development cartridge, and a transmission portion configured to transmit information indicating that it is necessary to replace the development cartridge to form an image per size of the recording member, based on a developer amount within the development cartridge detected by the detection unit to the external device.

Further features of the present invention will become apparent from the following description of exemplary embodiments with reference to the attached drawings.

BRIEF DESCRIPTION OF THE DRAWINGS

FIG. 12A is a status screen of a cartridge of the second embodiment, illustrating statuses in sizes of a plurality of recording members on the same screen.

FIG. 12B is a status screen of the cartridge of the second embodiment illustrating statuses in sizes of a plurality of recording members in a state where the screen is switchable per size.

DESCRIPTION OF THE EMBODIMENTS

First Embodiment

Figure 1:
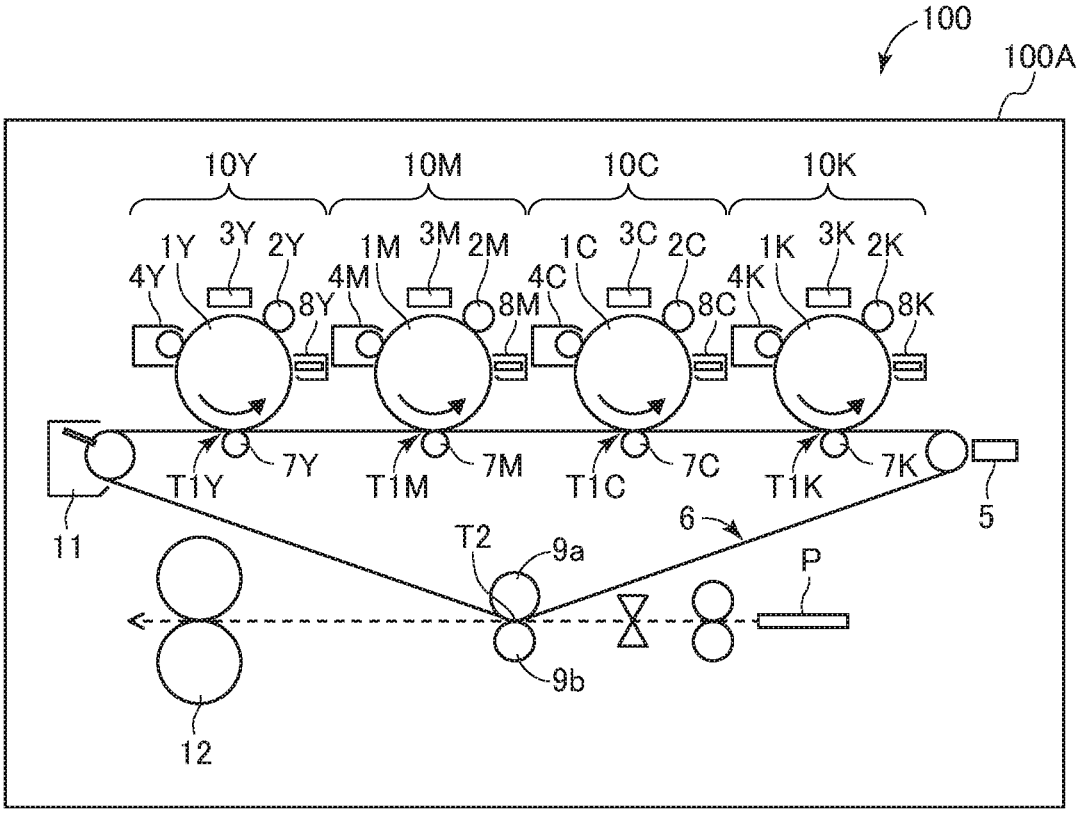
FIG. 1 is a schematic diagram illustrating a configuration of an image forming apparatus of a first embodiment.

A first embodiment of the present disclosure will be described with reference to FIGS. 1 through 10. Firstly, a configuration of an image forming apparatus of the present embodiment will be schematically described with reference to FIGS. 1, 2A and 2B.

Image Forming Apparatus

The image forming apparatus 100 is an electro-photographic full-color printer including four image forming stations 10Y, 10M, 10C and 10K respectively having photosensitive drums 1Y, 1M, 1C and 1K serving as image bearing members. The image forming apparatus 100 is configured to form a toner image, i.e., an image, on a recording member P corresponding to image signals transmitted from a document reading apparatus (not illustrated) and connected to an apparatus body 100A or an external device such as a personal computer communicably connected to the image forming apparatus 100A. The recording member includes one of a sheet of paper, a plastic film, and a sheet member such as a cloth. The image forming stations 10Y, 10M, 10C and 10K form toner images of yellow, magenta, cyan, and black, respectively.

Note that the image forming stations 10Y, 10M, 10C and 10K of the image forming apparatus 100 have substantially the same configuration except that colors to be developed are different. Accordingly, the image forming station 10Y will be typically described below and a description of the other image forming stations will be omitted.

The image forming station 10Y is provided with the photosensitive drum 1Y which is a cylindrical photosensitive member and which serves as an image bearing member. The photosensitive drum 1Y is rotationally driven in a direction of an arrow indicated in FIG. 1 and is capable of bearing an electrostatic latent image. Disposed around the photosensitive drum 1Y are a charging roller 2Y serving as a charging unit, a developing unit 4Y, a primary transfer roller 7Y and a cleaning unit 8Y. An exposing unit, i.e., a laser scanner, 3Y is disposed above the photosensitive drum 1Y in FIG. 1.

Still further, an intermediate transfer belt 6 is disposed so as to face the photosensitive drums 1Y, 1M, 1C and 1K. The intermediate transfer belt 6 is stretched by a plurality of tension rollers and is circularly moved in a direction of an arrow in FIG. 1 by being driven by a driving roller within the plurality of tension rollers. A secondary transfer outer roller 9*b* is disposed at a position facing, through the intermediate transfer belt 6, a secondary transfer inner roller 9*a* among the plurality of tension rollers, and composes a secondary transfer portion T2 where a toner image on the intermediate transfer belt 6 is transferred onto the recording member P. A fixing unit 12 is disposed downstream of the secondary transfer portion T2 in a recording member conveyance direction.

A process for forming an image by the image forming apparatus 100 constructed as described above will be described below. Firstly, as an image forming operation starts, a surface of the rotating photosensitive drum 1Y is homogeneously charged by the charging roller 2Y to which a predetermined charging bias is applied. Next, the photosensitive drum 1Y is exposed with a laser beam corresponding to an image signal emitted from the exposing unit 3Y. Thereby, an electrostatic latent image corresponding to the image signal is formed on the photosensitive drum 1Y. The electrostatic latent image on the photosensitive drum 1Y is developed and visualized as a toner image by toner 41 (see FIG. 2) stored within the developing unit 4Y.

The toner image formed on the photosensitive drum 1Y is primarily transferred onto the intermediate transfer belt 6 at a primary transfer portion T1Y composed of the photosensitive drum 1Y and a primary transfer roller 7Y disposed across the intermediate transfer belt 6. After the primary transfer, the toner, i.e., transfer residual toner, left on the surface of the photosensitive drum 1Y is removed by the cleaning unit 8Y.

Such operation is sequentially carried out by the respective image forming units of magenta, cyan and black, and four toner images are superimposed on the intermediate transfer belt 6. After that, the recording member P stored in a recording member storing cassette (not illustrated) is conveyed to the secondary transfer portion T2 while synchronizing with the toner image forming timing, and the four color toner images on the intermediate transfer belt 6 are secondarily and collectively transferred onto the recording member P. Toner left on the intermediate transfer belt 6 without being transferred at the secondary transfer portion T2 is removed by an intermediate transfer belt cleaner 11.

Next, the recording member P is conveyed to the fixing unit 12. Then, the fixing unit 12 melts and blends the toners on the recording member P by heating and pressing the recording member P to fix the toners as a full-color image on the recording member P. After that, the recording member P is discharged out of the apparatus. Note that in a case where a duplex mode of forming an image on a back of the recording member P is selected, the recording member P on which the toner image has been fixed on one surface thereof is conveyed to a reverse conveyance path (not illustrated) to reverse front and back surfaces of the recording member P. Then, the recording member P is conveyed again to the secondary transfer portion T2 to form an image on the back surface of the recording member P in the same manner as described above. Thereby, a series of the image forming process ends. Note that it is also possible to form a desirable mono-color or plural-color image by using only the necessary image forming unit(s).

Still further, a concentration detection sensor 5 is disposed at a position facing the intermediate transfer belt 6 downstream of the primary transfer portion T1K and upstream of the secondary transfer portion T2 in terms of the rotation direction of the intermediate transfer belt 6. The concentration detection sensor 5 is configured to be able to detect concentration of the toner image on the intermediate transfer belt 6. For instance, a controlling toner image, i.e., a patch image, is formed on the intermediate transfer belt 6, and the concentration detection sensor 5 detects concentration of the patch image. Thus, the concentration detection sensor 5 is used in controlling the concentration adjustment of the toner image by controlling intensity of exposure of the exposing units 3Y through 3K and various voltages, for example.

Figure 2A:
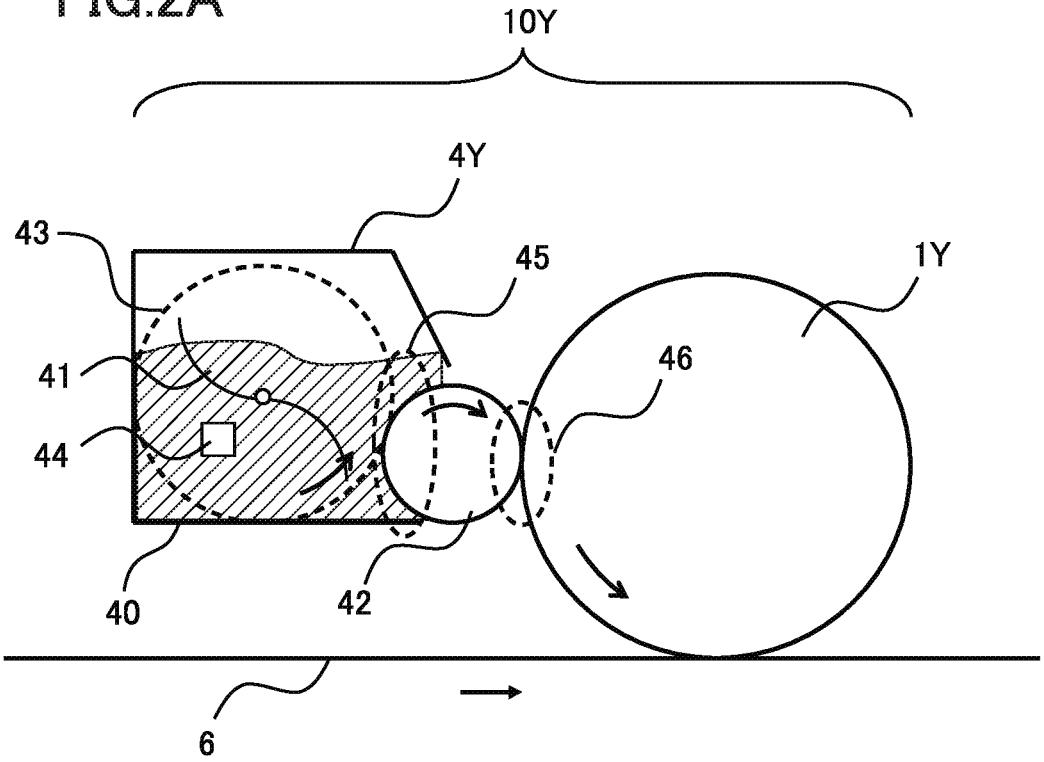
FIG. 2A is a schematic diagram illustrating a part of a configuration of an image forming station of the first embodiment in a state in which a sufficient remaining toner amount is left.
Figure 2B:
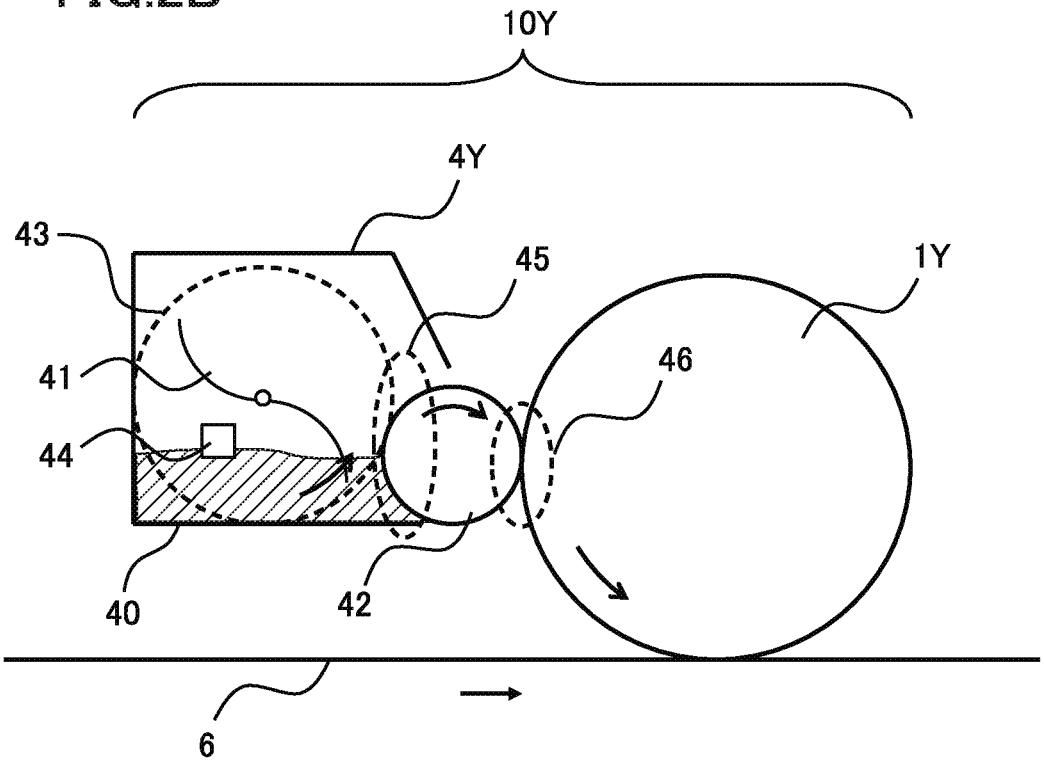
FIG. 2B is the schematic diagram illustrating the part of the configuration of the image forming station of the first embodiment in a state in which a less remaining toner amount is left.

Next, the developing unit 4Y will be described in detail with reference to FIGS. 2A and 2B. FIGS. 2A and 2B illustrate the developing unit 4Y and the photosensitive drum 1Y in the image forming station 10Y. The developing units 4Y through 4K of the present embodiment are removably attached to the image forming apparatus 100A (see FIG. 1) as development cartridges respectively storing developer. Because the developing units 4Y through 4K have the same structure, only the developing unit 4Y will be described with reference to FIGS. 2A and 2B and a description of the other developing units will be omitted.

The developing unit 4Y includes a storage container 40, a developing roller 42 serving as a developer bearing member, a supply member 43 and a remaining toner amount sensor 44. The storage container 40 stores the nonmagnetic toner 41 indicated by a hatched part in FIG. 2A and serving as the developer. The developer used in the present embodiment is one-component developer containing the nonmagnetic toner. The developing roller 42 is disposed rotatably at an opening part formed at a position facing the photosensitive drum 1Y of the storage container 40. The developing roller 42 bears and conveys the toner 41 as the roller rotates in a direction of an arrow in FIGS. 2A and 2B and develops the electrostatic latent image borne on the photosensitive drum 1Y by the toner 41. At this time, a predetermined developing bias is applied to the developing roller 42. The supply member 43 supplies the toner 41 in the storage container 40 to the developing roller 42. The supply member 43 supplies the toner 41 to the developing roller 42 within the storage container 40 while agitating the toner 41 by rotating in a direction of an arrow in FIGS. 2A and 2B. The remaining toner amount sensor 44 is provided on a wall surface of the storage container 40 to detect a remaining toner amount, i.e., a remaining amount of the developer, within the storage container 40.

More specifically, as the toner 41 is supplied to the developing roller 42, a toner layer is formed on a surface of the developing roller 42 around an inner side 45 of the storage container 40 as illustrated in FIG. 2A. Then, as the developing roller 42 rotates in the direction of the arrow, the toner layer is conveyed to a counter position 46 facing the photosensitive drum 1Y, and the electrostatic latent image formed by the exposing unit 3Y (see FIG. 1) is developed by the toner 41. The toner layer on the surface of the developing roller 42 at a part used for the development becomes thin. The developing roller 42 rotates further from the counter position 46 facing the photosensitive drum 1Y and receives again the toner 41 supplied from the supply member 43 within the storage container 40. Then, the developing roller 42 forms a sufficient toner layer. The developing roller 42 continuously forms images normally by repeating the toner supply by the supply member 43 and the development by the toner 41 on the photosensitive drum 1Y.

Detection of Remaining Toner Amount

Figure 3A:
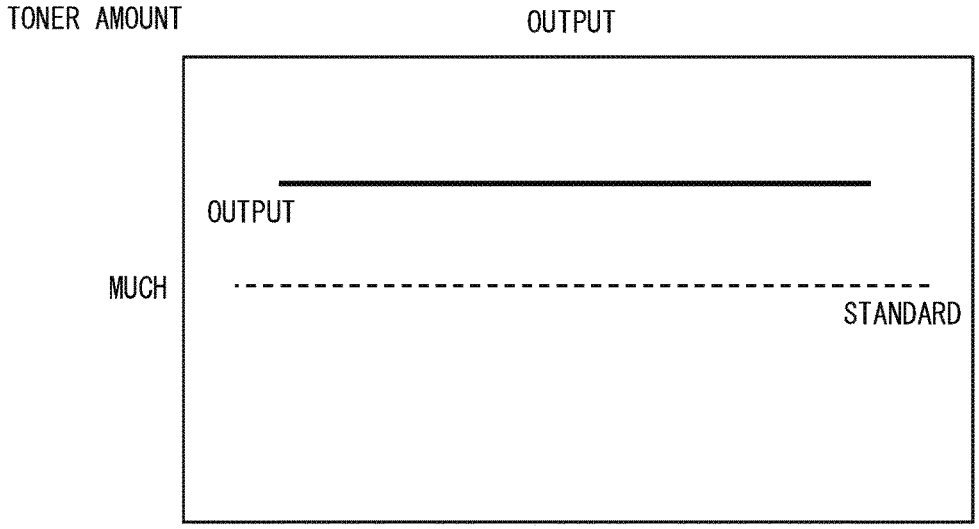
FIG. 3A illustrates a relationship between a toner amount of a remaining toner amount sensor and an output of the sensor in a state in which the toner amount is high.
Figure 3B:
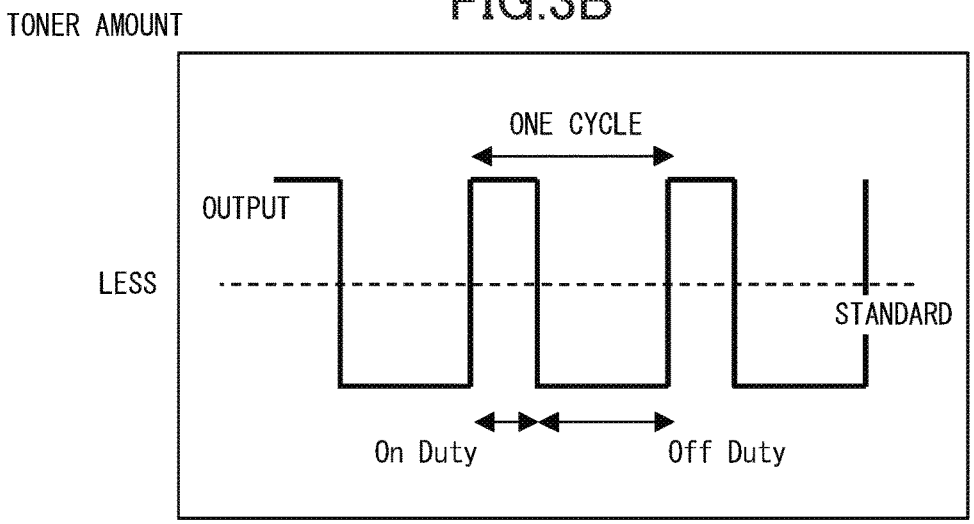
FIG. 3B illustrates a relationship between a toner amount of the remaining toner amount sensor and an output of the sensor in a state in which the toner amount is low.
Figure 3C:
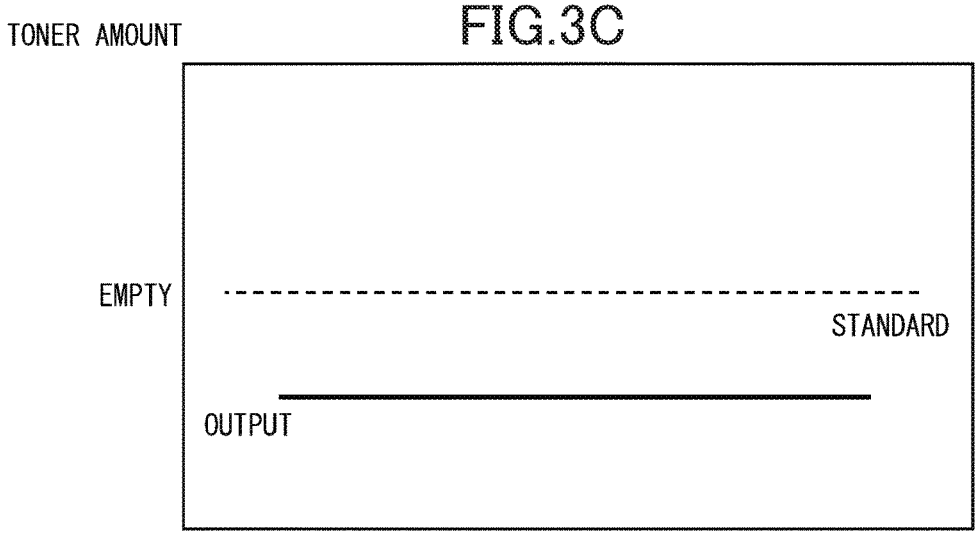
FIG. 3C illustrates a relationship between a toner amount of the remaining toner amount sensor and an output of the sensor in a state in which the toner amount is empty.

A method for detecting the remaining toner amount by the remaining toner amount sensor 44 will be described with reference to FIGS. 3A through 3C. According to the present embodiment, the remaining toner amount sensor 44 uses a piezoelectric device and increases an output thereof in a case where the toner 41 is present at a sensor counter surface. The toner 41 within the storage container 40 passes in front of the remaining toner amount sensor 44 by being agitated by the supply member 43. In a case where a toner amount is large, the output with respect to a reference value continues to be high as illustrated in FIG. 3A. Meanwhile, in a case where the toner amount is empty, the output with respect to the reference value continues to be low as illustrated in FIG. 3C.

Then, in a case where the toner amount is small, the output of the sensor repeats On and Off by reflecting cases where the toner 41 is present and is absent in front of the counter surface of the remaining toner amount sensor 44 as the supply member 43 rotates and agitates the toner. As a result, as indicated by the graph in FIG. 3B, the output repeats an On Duty time during which the toner 41 is detected and an Off Duty time during which no toner 41 is detected in connection with an agitation cycle of the supply member 43. Because the supply member 43 includes two agitation blades, a half rotation of the supply member 43 corresponds to one cycle in FIG. 3B. Because the toner amount is strongly correlated with the On Duty (Off Duty) time, it is possible to detect the toner amount from the On Duty (Off Duty) time.

Note that the remaining toner amount from a position where the remaining toner amount within the storage container 40 is full to a position where the remaining toner amount sensor 44 can detect On Duty and Off Duty, and the remaining toner amount from that position to a position where the remaining toner amount within the storage container 40 is detected to be empty can be found as follows. For instance, the remaining toner amount can be found by a dot count method for finding a toner consumption amount by counting each individual image signal forming a dot used in general, i.e., a video count value. According to the present embodiment, the remaining toner amount is detected by a system including the dot count method and the remaining toner amount sensor 44.

Control Portion

Figure 4:
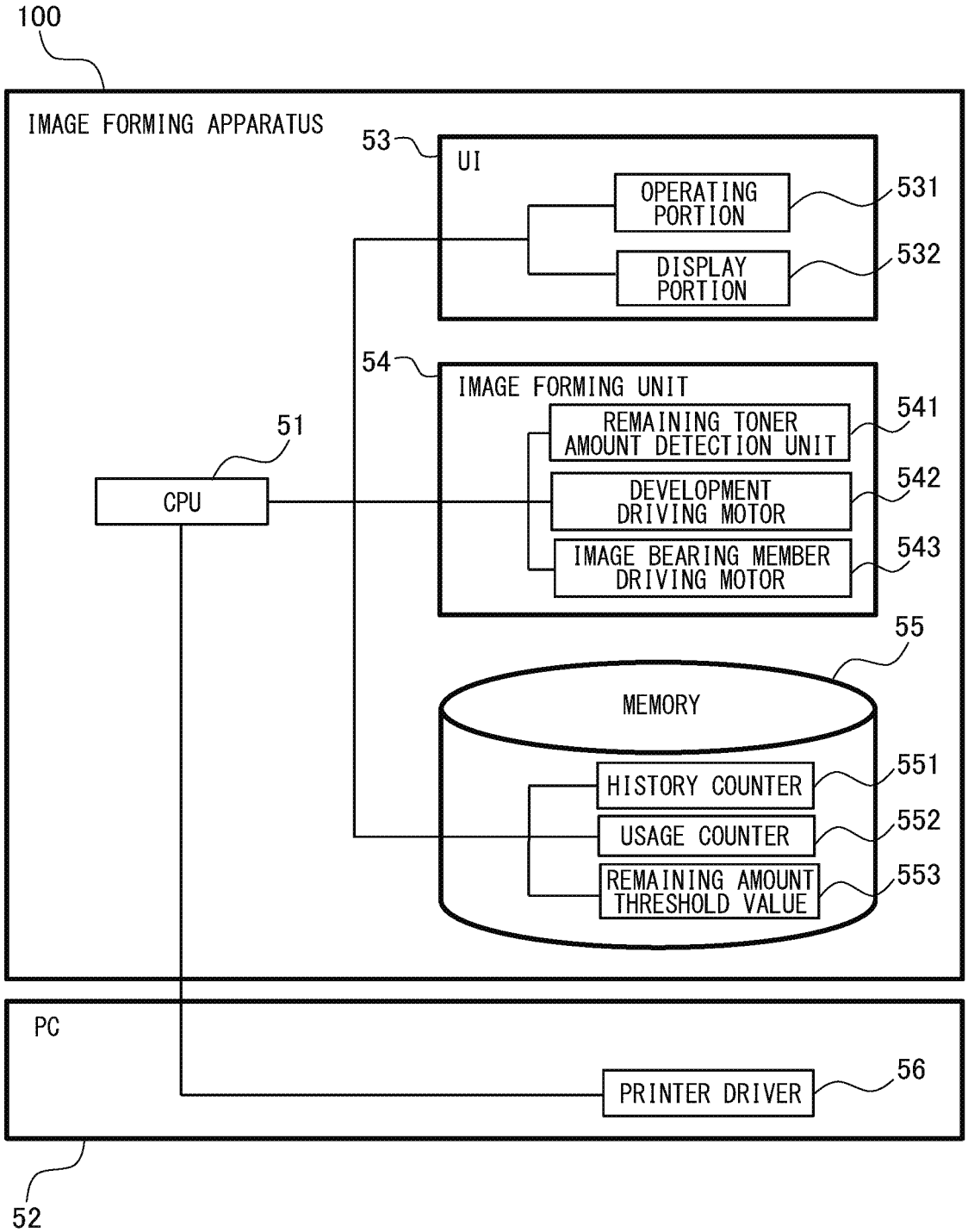
FIG. 4 is a control block diagram of the image forming apparatus of the first embodiment.

Next, a control system of the image forming apparatus 100 will be described with reference to FIG. 4. The image forming apparatus 100 is connected with a personal computer (PC) 52 or the like serving as an external device through a network, a USB line, and others. A printing job is inputted to a CPU 51 of the image forming apparatus 100 from the PC 52 through an application such as a printer driver 56. In a case where the image forming apparatus is a multi-function printer including a document reading apparatus, there is a case where an image read from a reader scanner (not illustrated) is inputted as a copying job.

The CPU 51 serving as a control portion controlling the image forming apparatus 100 is connected with a User Interface (UI) 53, an image forming unit 54 and a memory 55. The UI 53 includes an operating portion 531 enabling the user to operate the image forming apparatus 100 and a display portion 532 displaying various information. The image forming unit 54 includes a remaining toner amount detection unit 541, a development driving motor 542 serving as a motor for driving the developing unit 4Y (4M, 4C and 4K) and an image bearing member driving motor 543 serving as a motor for driving the photosensitive drums 1Y (1M, 1C and 1K) and the intermediate transfer belt 6. The remaining toner amount detection unit 541 is provided in each of the developing units 4Y through 4K and detects a remaining toner amount of each of the developing units 4Y through 4K from both of a signal of the remaining toner amount sensor 44 and a toner consumption amount found by the dot count method. The remaining toner amount detection unit 541 corresponds to a detection unit configured to detect a developer amount within the development cartridge. The memory 55 includes a history counter 551, a usage counter 552, a remaining amount threshold value 553 and others described later.

Display Screen of PC

Figure 5:
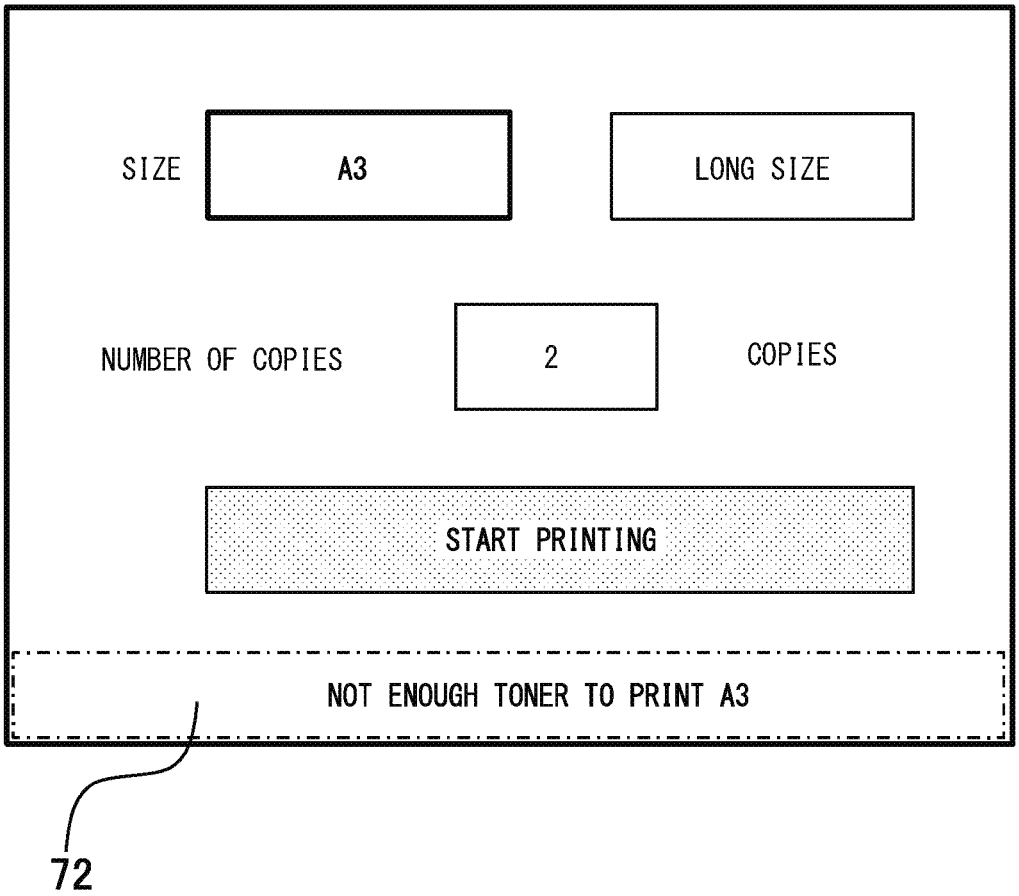
FIG. 5 illustrates a display screen of a printer driver in forming an image according to the first embodiment.

FIG. 5 is a display screen of the printer driver 56 of the PC 52. This kind of screen is displayed when the user selects Print from an arbitrary application on the PC 52. This screen enables the user to set a size of a sheet, i.e., a recording member, and a number of prints. A job is inputted from the PC 52 to the image forming apparatus 100 by selecting "Start Printing". This screen also has a status display area 72 notifying the user of a state of the image forming apparatus 100 under the display screen. Here, what has to be informed to the user such as an error, JAM display indicating sheet jamming or what is being presently executed is displayed in this area.

Display Screen of UI

Figure 6A:
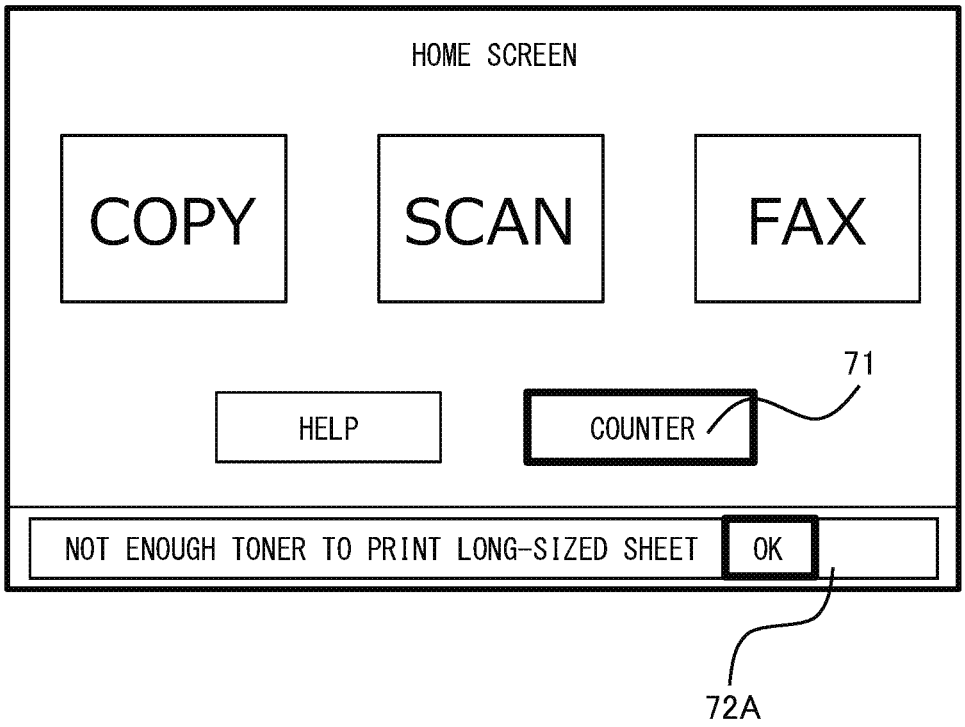
FIG. 6A illustrates a state in which a long-sized sheet is selected in a screen displayed on a display portion of the image forming apparatus of the first embodiment.
Figure 6B:
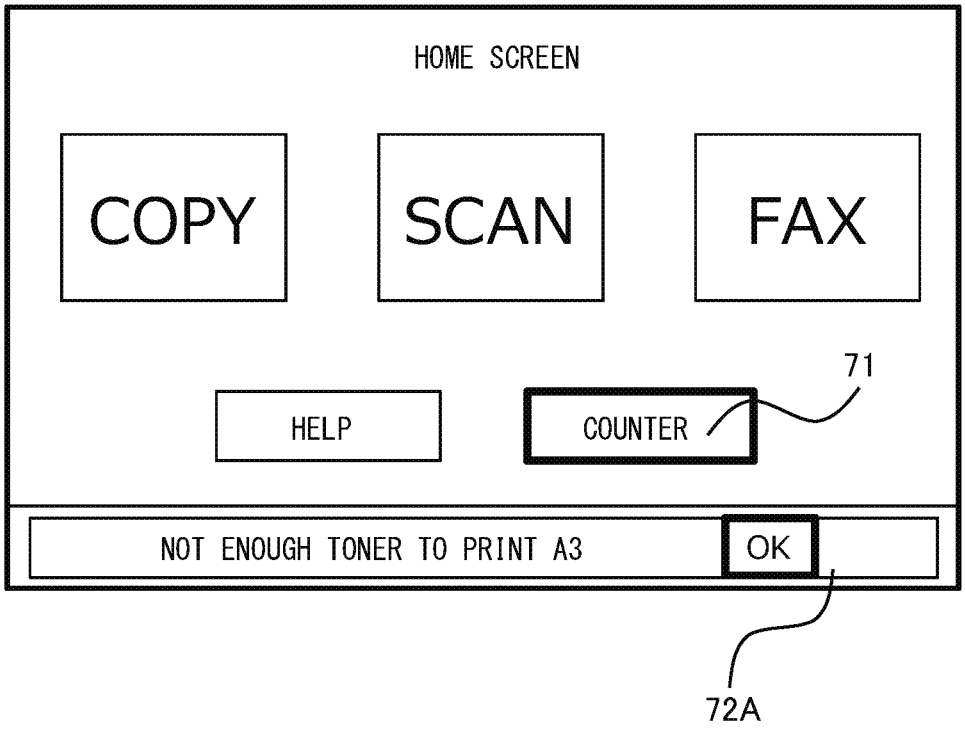
FIG. 6B illustrates a state in which an A3-sized sheet is selected in the screen displayed on the display portion of the image forming apparatus of the first embodiment.

FIGS. 6A and 6B illustrate display screens of the display portion 532 of the UI 53 (see FIG. 4) in the image forming apparatus 100. The UI 53 is formed of a touch panel and functions as the display portion 532 and the operating portion 531. A 'HOME screen', which is a standard screen, includes a 'COPY' button by which the user copies, a 'SCAN' button by which an image is scanned from a reader scanner and is transmitted to the PC 52, and a 'FAX' button by which a facsimile function operates. The 'HOME screen' also includes a 'Help' button used in making reference when the user needs help on how to use the apparatus and a 'Counter' button 71 for confirming usage of cartridges i.e., developing units 4Y through 4K in the present embodiment, which are consumables.

The respective functions are started by touching the respective buttons. Still further, the UI 53 includes a status display area 72A for notifying the user of a status of the image forming apparatus 100 at a lower part of the screen similarly to the screen of the printer driver of the PC 52. It is noted that FIG. 6A displays that there is no toner for the long-sized sheet, i.e., indicates that the toner within the cartridge is insufficient to form an image on a long-sized recording member, and FIG. 6B displays that there is no toner for the A3-sized sheet.

Toner Coating Amount

Figure 7A:
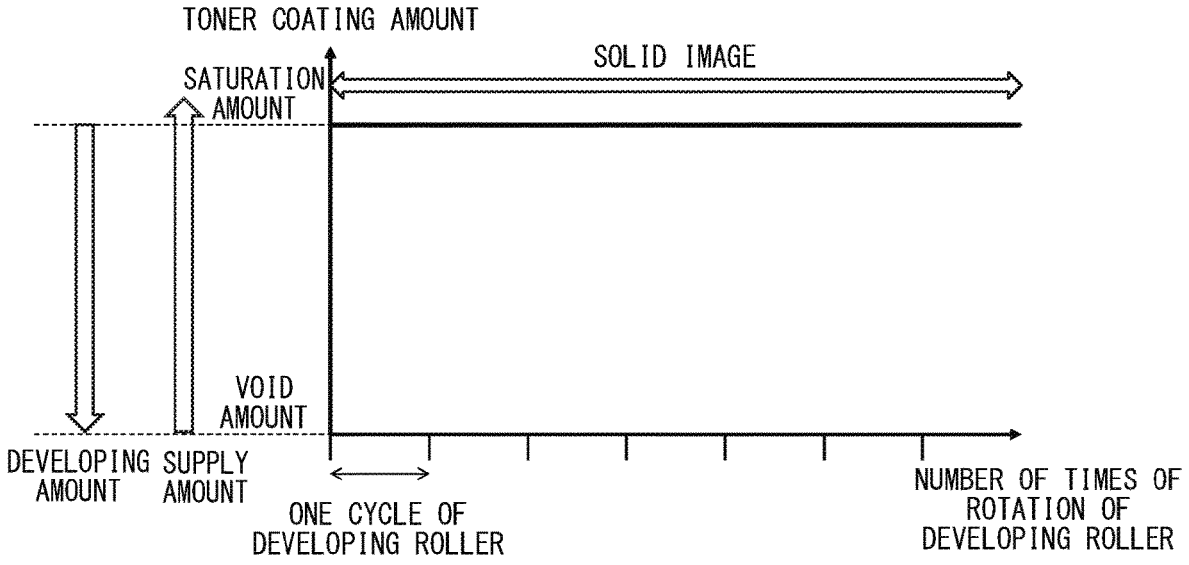
FIG. 7A is a chart illustrating a transition of a toner coating amount of the first embodiment in a case where a supply amount is greater than a developing amount.
Figure 7B:
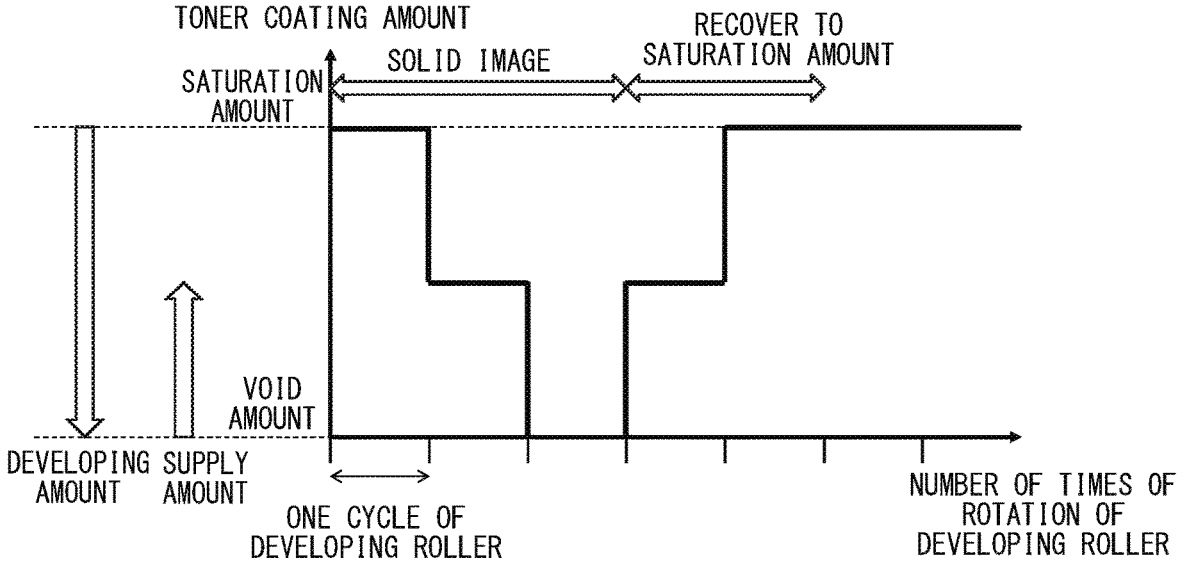
FIG. 7B is a chart illustrating a transition of the toner coating amount of the first embodiment in a case where a supply amount is less than a developing amount.

Next, an amount of the toner layer (referred to as a 'toner coating amount' hereinafter) on the surface of the developing roller 42 will be described in detail by using FIGS. 7A and 7B while making reference to FIGS. 2A and 2B. An axis of ordinates in charts in FIGS. 7A and 7B represents the toner coating amount on the developing roller 42. A downward arrow, i.e., 'Developing Amount' in FIGS. 7A and 7B, indicates a toner coating amount that decreases in conducting the development on the photosensitive drum 1Y while the developing roller 42 makes one turn in forming a whole solid image. An upward arrow, i.e., 'Supply Amount', indicates a toner coating amount of the developing roller 42 recovered by toner supplied by the supply member 43 while the developing roller 42 makes one turn.

'Void Amount' on the axis of ordinates represents an amount by which a part of an image falls out, i.e., blurs, because the toner coating amount decreases and the toner 41 to be developed on the photosensitive drum 1Y is insufficient. 'Saturation Amount' on the axis or ordinates represents a maximum toner amount that can be coated on the developing roller 42. Even in a case where the supplied amount exceeds the saturation amount, the toner coating amount on the developing roller 42 will not exceed the saturation amount. An axis of abscissa represents a number of times of rotation of the developing roller 42 from a leading edge of an image. Here, one division of the scale is delimited by one cycle, i.e., one rotation, of the developing roller.

In a case where a sufficient remaining toner amount is present in the developing units 4Y through 4K (referred to as a 'cartridge' hereinafter) as illustrated in FIG. 2A, the toner coating amount has a relationship of 'Developing Amount'≤'Supply Amount'. Therefore, even in a case where a solid image as indicated by a bidirectional arrow is to be formed by the developing roller 42 that continuously rotates by many times, the toner coating amount continuously keeps the 'Saturation Amount'.

Meanwhile, if the remaining toner amount within the cartridge is small as illustrated in FIG. 2B, the toner coating amount has a relationship of 'Developing Amount'>'Supply Amount' as indicated in FIG. 7B, and the toner coating amount decreases every time when the developing roller 42 makes one turn. Here, the image becomes void at a third round of the developing roller 42. In a case where no image is to be formed, e.g., in a case where no development by toner is made as an image pattern or in a case of a non-imaging area between recording members in starting to form an image on a next recording member after forming an image until a trailing edge of a recording member, the toner coating amount recovers by a supplied amount every time when the developing roller 42 rotates. Here, the toner coating amount recovers to the saturation amount by making the developing roller 42 rotate two turns.

Relationship Between Remaining Toner Amount and Toner Supply Amount

Figure 8:
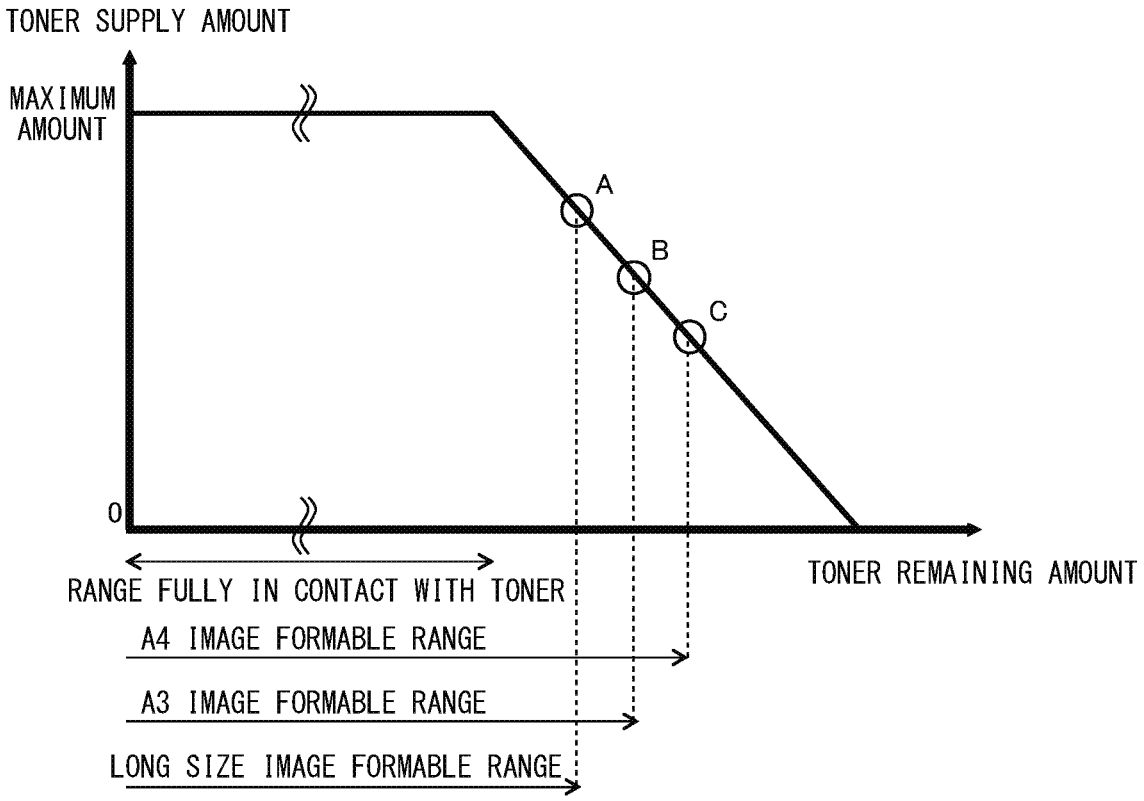
FIG. 8 is a chart illustrating a relationship between a remaining toner amount and a toner supply amount according to the first embodiment.

FIG. 8 illustrates a relationship between the remaining toner amount in the cartridge and the toner supply amount. An axis of abscissa represents the remaining toner amount. A left side of the chart indicates a state in which a sufficient amount of toner is present and a right side of the chart indicates a state in which a less amount of toner is present. An axis of ordinates represents the toner supply amount from the supply member 43 to the developing roller 42 as described above. If there is a sufficient remaining toner amount as illustrated in FIG. 2A, there is a time in which the developing roller 42 contacts fully with the toner 41 at the inner side 45 of the storage container 40 until when the developing roller 42 rotates to the position facing the photosensitive drum 1Y again after the developing roller 42 has developed the latent image on the photosensitive drum 1Y. Therefore, a certain supply amount or a maximum amount of toner from the supply member 43 to the developing roller 42 is assured.

Meanwhile, as toner is consumed further as images are formed and the remaining toner amount exceeds "a range in which the developing roller 42 fully contacts with toner", a time during which the developing roller 42 contacts with the toner 41 at the inner side 45 of the storage container 40 is shortened as illustrated in FIG. 2B. Therefore, the toner supply amount from the supply member 43 to the developing roller 42 starts to decrease and the toner coating amount becomes a relationship of 'Developing Amount'>'Supply Amount', becoming a state of possibly causing voids.

Relationship Between Toner Coating Amount and Size of Recording Material

Figure 9A:
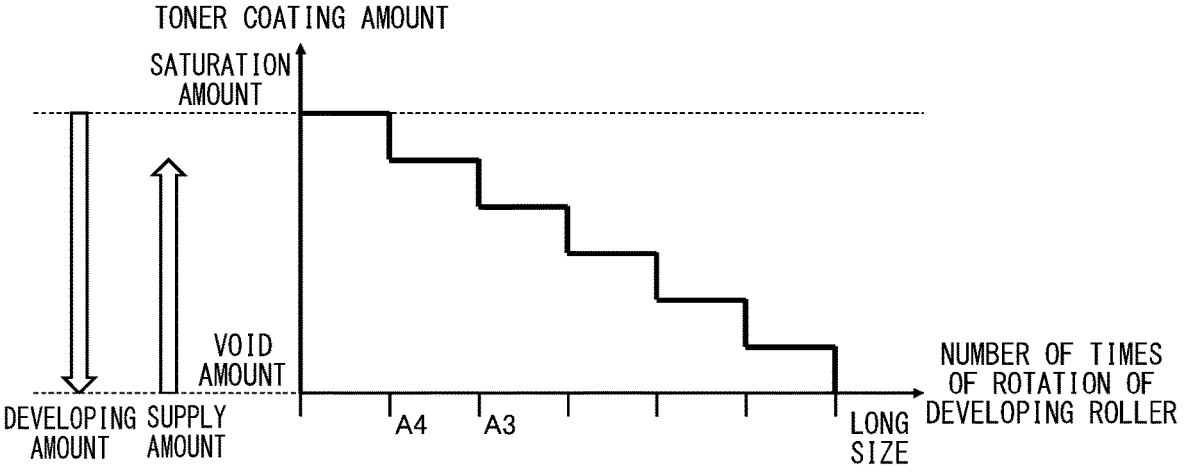
FIG. 9A is a chart illustrating a transition of a toner coating amount per size of a recording member of the first embodiment in a case where a supply amount is slightly less than a developing amount.
Figure 9B:
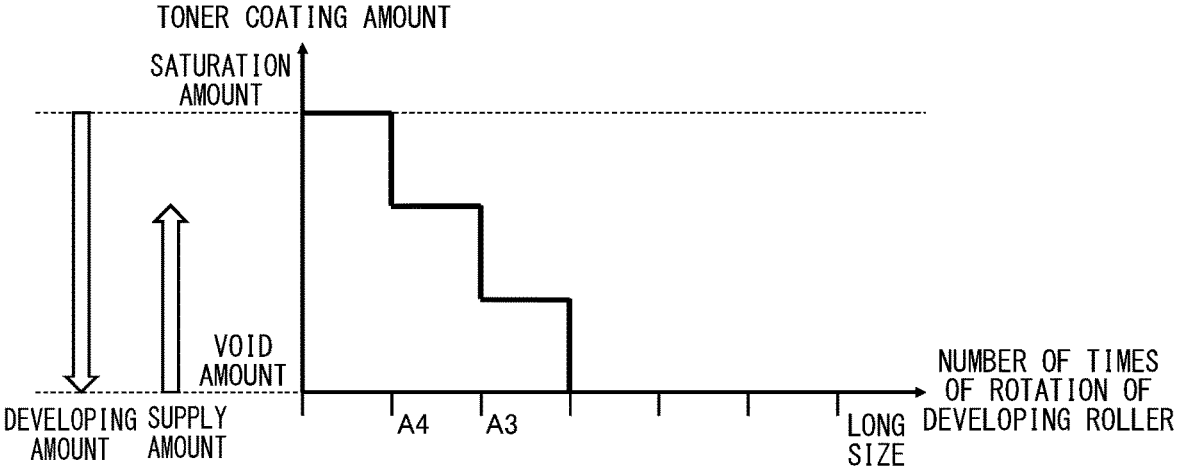
FIG. 9B is a chart illustrating a transition of a toner coating amount per size of a recording member of the first embodiment in a case where a supply mount is less than a developing amount.
Figure 9C:
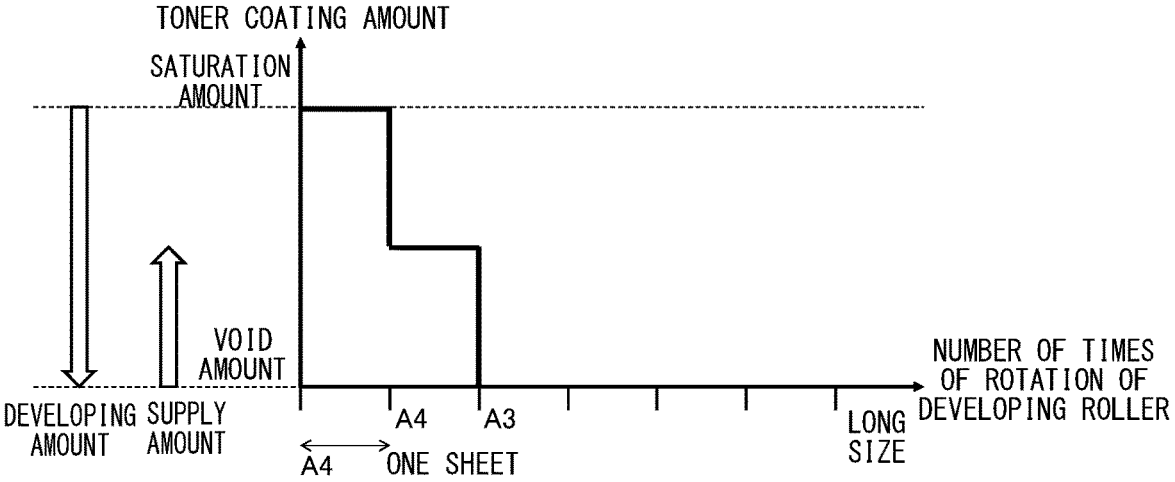
FIG. 9C is a chart illustrating a transition of a toner coating amount per size of a recording member of the first embodiment in a case where a supply mount is further less than a developing amount.

Next, an influence of the toner coating amount on a size of a recording member (sheet of paper) will be described. FIGS. 9A through 9C are charts illustrating transitions of the toner coating amount in continuously forming solid images by converting one division in FIG. 7 described above into a number of times of rotation of the developing roller 42 in forming an image on about one A4-sized sheet (210 mm). Actually, while the developing roller 42 rotates by several times in forming one image on the A4-sized sheet, the chart schematically indicates such that the toner coating amount increases/decreases once during one division of the scale. As the remaining toner amount within the cartridge decreases, the toner supply amount also decreases as illustrated in FIG. 8, so that a decreased amount of the toner coating amount becomes large when the developing roller 42 rotates once.

FIG. 9A illustrates a state in which an image can be formed on a long-sized sheet (1200 mm). FIG. 9B illustrates a state in which even though an image can be formed on an A3-sized sheet, voids are already caused in a case where an image is formed on the long-sized sheet. FIG. 9C illustrates a state in which an image can be formed tightly on the A3-sized sheet. That is, the smaller the remaining toner amount within the cartridge, the smaller the size of the recording member is on which an image can be formed without causing voids. Note that a numerical value within a parenthesis of each size described above indicates a length in a conveyance direction of a recording member, and the longer the length, the more a number of times of rotation of the developing roller 42 increases in forming an image on that recording member.

'No Toner' Display

Here, arrows along the axis of abscissa in FIG. 8 indicate ranges of the remaining toner amount by which images can be formed on recording members of the respective sizes. An 'Out Display' urging to replace the cartridge as the toner 41 is depleted is displayed when the remaining toner amount detected by the remaining toner amount detection unit 541 is lower than a remaining amount threshold value 553 set in advance. This 'Out Display' corresponds to a display that there is no toner within the cartridge, i.e., that the toner within the cartridge is insufficient to form an image on a recording member of that size, and to a display of information concerning replacement of the cartridge, i.e., that it is necessary to replace the cartridge to form an image on a recording member of that size.

For instance, in a case of an image forming apparatus handling the A3-sized sheet, an arrangement may be set so as to display the 'Out Display' slightly before an A3 image formable range in FIG. 8, i.e., B accompanied by a circle in FIG. 8. Thereby, even if a solid image is formed on the A3-sized sheet, no void will be generated. However, the long-sized sheet causes voids before that point. It is also possible to arrange so as to set 'Out Display' slightly before a long size image formable range, i.e., A accompanied by a circle, so that no void occurs even in the long-sized sheet. In this case, if an image is to be formed with the A3-sized sheet or the A4-sized sheet, the replacement of the cartridge is urged at a timing in which even a solid image can be formed.

That is, according to the present embodiment, the UI 53 serving as a display portion displays No Toner Display indicating that there is no toner within the cartridge, i.e., that the toner within the cartridge is insufficient to form an image per size of the recording member, based on the remaining toner amount in the cartridge. For instance, FIG. 6A displays that there is no toner for the long-sized sheet and FIG. 6B displays that there is no toner for the A3-sized sheet, respectively, as described above.

Note that such display may be displayed on a display screen of the printer driver of the PC 52. For instance, the display indicating that there is no toner for the A3-sized sheet is displayed in the display screen of the printer driver of the PC 52 in FIG. 5. In such a case, the CPU 51 serving as a transmission portion transmits information indicating that there is no toner within the cartridge, i.e., that the toner within the cartridge is insufficient to form an image, per size of the recording member, based on the remaining toner amount in the cartridge to the PC 52 serving as an external device. The CPU 51 may be also arranged so as to transmit information that there is no toner within the cartridge, i.e., that the toner within the cartridge is insufficient to form an image on a recording member of that size, per size of the recording member, based on the remaining toner amount in the cartridge to a system managing a life of the cartridge such as an external server.

Figure 10:
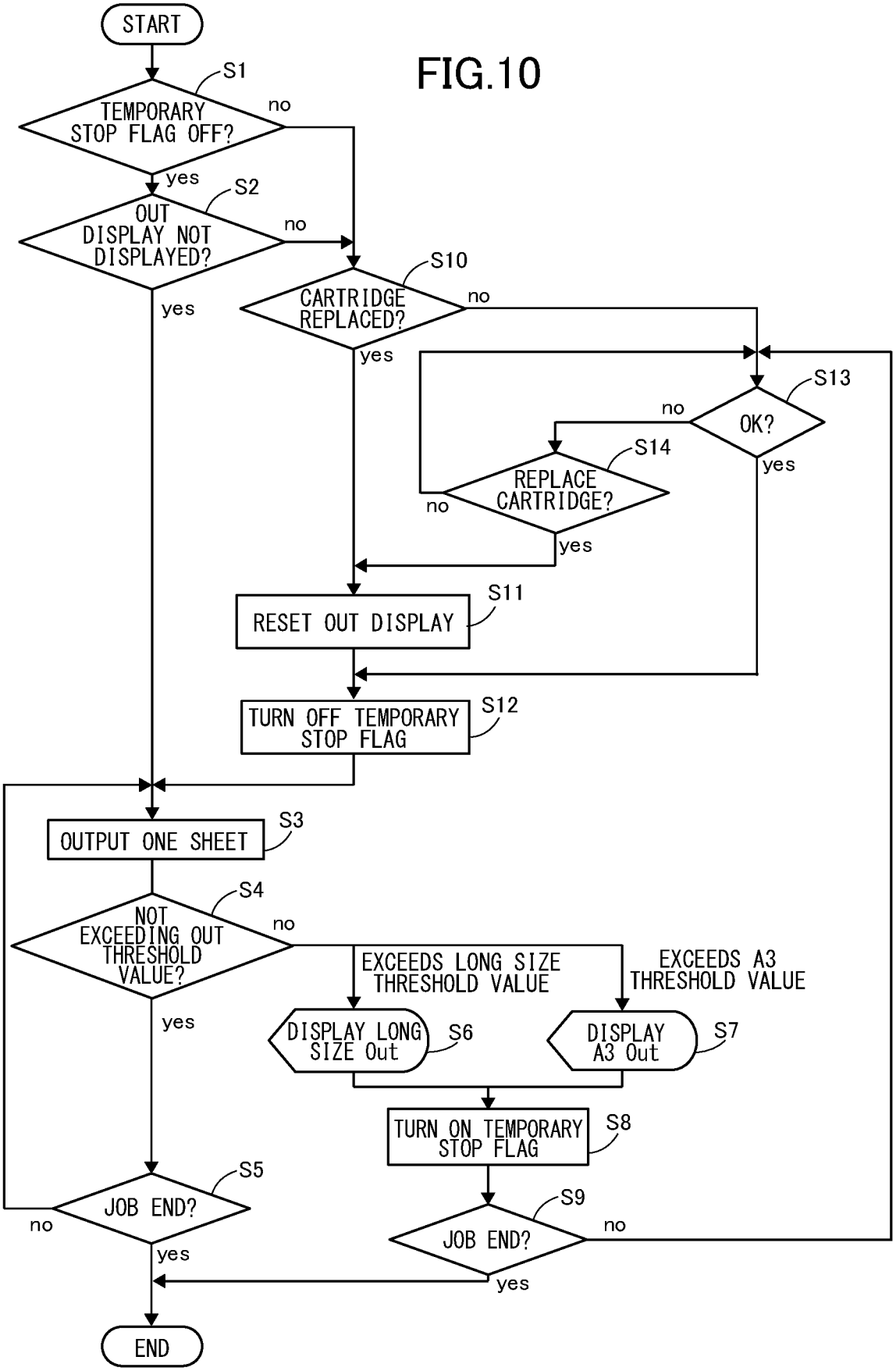
FIG. 10 is a flowchart for making No Toner display depending on sizes of recording members of the first embodiment.

Flow of Making No Toner Display (Out Display) Depending on Size of Recording Material The display indicating that there is no toner depending on a size of a recording member will be described below with reference to FIG. 10. FIG. 10 illustrates a case of forming an image on the A3-sized sheet. Suppose that the user outputs by pressing 'Start Printing' after selecting the 'A3' size as a normal office use image in the printer driver 56 (see FIGS. 4 and 5). Note that an image forming job described below is a period from starting of formation of an image on the recording member until completing the formation of the image based on an image forming signal forming the image on the recording member.

Firstly, a case where there is plenty of toner within the cartridge will be described. After starting the image forming job, the CPU 51 (see FIG. 4) confirms whether a 'temporary stop flag' for confirming whether the image forming apparatus is in a temporary stop state is Off in Step S1. Because it is Off yet here, i.e., Yes in Step S1, the CPU 51 confirms whether Toner Out display, i.e., no toner display, is being displayed in Step S2. Because it is not displayed yet here, i.e., Yes in Step S2, the CPU 51 outputs one recording member on which an image has been formed in Step S3 to compare a remaining toner amount in the cartridge with the remaining amount threshold value 553 (see FIG. 4) of the Out display in Step S4. In a case where the remaining toner amount does not exceed the remaining amount threshold value 553, i.e., Yes in Step S4, the CPU 51 confirms whether the job has been ended in Step S5. In a case where the job has been ended, i.e., Yes in Step S5, the CPU 51 ends the image forming job (Job End). In a case where the job has not been ended, i.e., No in Step S5, the CPU 51 returns to Step S3 to output a next recording member.

Next, a case where the toner within the cartridge is reduced will be described. In Step S4, the remaining amount threshold value 553 of the Out display has two stages for the long-sized sheet and the A3-sized sheet. As the remaining toner amount within the cartridge decreases by continuing the formation of images, the remaining toner amount exceeds first a remaining amount threshold value for the long-sized sheet, i.e., No in Step S4. At this time, a message of "No Toner for Printing on Long-sized Sheet", i.e., Out display, and the 'OK' button are displayed in the status display area 72A of the display portion 532 of the UI 53 (see FIG. 4) as illustrated in FIG. 6A in Step S6. Then, the CPU 51 turns on the 'temporary stop flag' for making judgment of temporarily stopping the formation of an image in Step S8. The CPU 51 confirms whether the job has been ended by the output in Step S9 and if the job has been ended, i.e., Yes in Step S9, the CPU 51 ends the image forming job (Job End). At this time, the UI 53 keeps displaying the message of "No Toner for Printing on Long-sized Sheet".

Next, a case where the cartridge has been replaced before starting a next image forming job after ending the former job in a state in which the 'temporary stop flag' is On will be described. Because the 'temporary stop flag' is On after starting the next image forming job, i.e., No in Step S1, the CPU 51 determines whether the cartridge has been replaced in Step S10. Because the cartridge has been replaced here, i.e., Yes in Step S10, the CPU 51 resets the message of "No Toner for Printing on Long-sized Sheet", i.e., Out display, cancels this display in Step S11, turns Off the 'temporary stop flag' in Step S12, and outputs the first sheet in Step S3.

Meanwhile, a case of starting a next image forming job without replacing the cartridge after ending the former job in the state in which the 'temporary stop flag' is On will be described. Because the 'temporary stop flag' is On, i.e., No in Step S1, and no cartridge has been replaced, i.e., No in Step S1, after starting the next image forming job, the CPU 51 determines whether the 'OK' button in the status display area 72A of the UI 53 has been pressed in Step S13. That is, the UI 53 serving as the display portion is capable of displaying a selection screen, i.e., the 'OK' button here, enabling the user to select whether the formation of the image is continued with the size of the recording member, i.e., the long-sized sheet here, for which the display (Out display) indicating that there is no toner within the cartridge has been made.

As the 'OK' button is pressed, i.e., Yes in Step S13, the CPU 51 considers that the user executes the image forming job upon recognizing that the remaining toner amount is in the Out state, turns off the 'temporary stop flag' in Step S12, and restarts the output in Step S3. That is, in a case where the selection of continuing the image forming job is made in the selection screen, i.e., in a case where the 'OK' button is pressed here, the CPU 51 continues the image forming job. At this time, the UI 53 keeps displaying the message of "No Toner for Printing on Long-sized Sheet". Still further, because the Out display is kept being displayed in Step S2 in a case where the image forming job is repeated, i.e., No in Step S2, the CPU 51 determines again whether the cartridge has been replaced in Step S10.

Next, a case where the cartridge is replaced after starting a next image forming job without replacing the cartridge after ending the former job in the state in which the 'temporary stop flag' is On will be described. In a case where the 'OK' button is not pressed in Step S13, i.e., No in Step S13, that state is maintained until when the cartridge is replaced in Step S14. As the cartridge is replaced, i.e., Yes in Step S14, the CPU 51 resets the Out display in Step S11, turns off the temporary stop flag in Step S12 and restarts the output in Step S3.

Next, a case where a remaining toner amount exceeds the remaining amount threshold value 553 for the A3-sized sheet in a case where the image forming job is continued as the 'OK' button is pressed, i.e., Yes in Step S13, in a state in which the long-size Out display is displayed in Step S6 will be described. In the case where the image forming job is continued when the 'OK' button is pressed, i.e., Yes in Step S13, in the state in which the long-size Out display is displayed, i.e., Step S6, the remaining toner amount within the cartridge decreases. Then, the remaining toner amount exceeds the remaining amount threshold value 553 for the A3-sized sheet at certain point, i.e., No in Step S4. At this time, the CPU 51 switches the display in the status display area 72A of the UI 53 to a message of "No Toner for Printing on A3-sized Sheet", i.e., Out display, and displays the 'OK' button as illustrated in FIG. 6B in Step S7. Operations thereafter are the same with the case where the remaining toner amount exceeds the remaining amount threshold value 553 for the long-sized sheet described above.

Thus, according to the present embodiment, the UI 53 displays that there is no toner within the cartridge or displays information concerning replacement of the cartridge, i.e., the Out display, per size of the recording member based on the remaining toner amount in the cartridge. This arrangement makes it possible to display that there is no toner within the cartridge or the information concerning the replacement at adequate timing corresponding to the size of the recording member. Then, the user can judge whether there is a possibility of causing voids with the size of the recording member on which an image is to be formed. As a result, the user can suppress an abnormal image such as a void image from be generated and can replace the toner cartridge at an adequate timing without leaving much toner within the cartridge.

Note that it is also possible to arrange such that the displays of 'Out display' and the 'OK' button are made on the display screen of the printer driver 56 as described above. In such a case, the CPU 51 may continue the formation of the image if the 'OK' button is pressed on the display screen of the PC 52 for example.

Still further, although the cases where the remaining amount threshold values 553 are those of two sizes of recording members of the A3-sized and long-sized sheets have been described above in FIG. 10, it is also possible to provide a remaining amount threshold value of another sized sheet such as a remaining amount threshold value of the A4-sized sheet indicated as C accompanied by a circle in FIG. 8. It is also possible to make the abovementioned judgment by providing equations and tables corresponding to a length in the conveyance direction of a recording member. It is exemplified by an inclined toner supply amount part including A, B and C accompanied by the circles of exceeding 'Range Fully Contacting with Toner' on the axis of abscissa in FIG. 8. This arrangement makes it possible to suppress the replacement of the cartridge from being urged in a state in which much toner is left.

Still further, although the case of temporarily stopping the image forming job of A3 by using the remaining amount threshold value 553 of the long-sized sheet in FIG. 10 is described above, such case may be limited only to a case where voids may occur with the size of the job. That is, in a case where an image is to be formed on the A3-sized sheet, it is also possible to arrange so as to use only the remaining amount threshold value 553 of A3. This arrangement makes it possible for the user to judge whether the image forming job is to be continued by noticing the state in which the remaining toner amount exceeds the threshold value as the image forming apparatus is temporarily stopped only when the image forming job is affected. In other words, it is possible to avoid the image forming job from being temporarily stopped when there is no influence on the image forming job.

SECOND EMBODIMENT

A second embodiment will be described below by using FIGS. 11 and 12 and with reference to FIGS. 1, 2 and 4. In the embodiment described above, the case of displaying 'Out display' that there is no toner within the cartridge per size of a recording member, i.e., that the toner within the cartridge is insufficient to form an image on a recording member of that size, has been described. Meanwhile, a case of displaying a remaining toner amount as information on a remaining developer amount usable for a size per size of a recording member will be described in the present embodiment. Because other configurations and operations are the same with those of the first embodiment, the same components will be denoted by the same reference signs and their description will be simplified or omitted. The following description will be made centering on parts different from the first embodiment.

Figure 11:
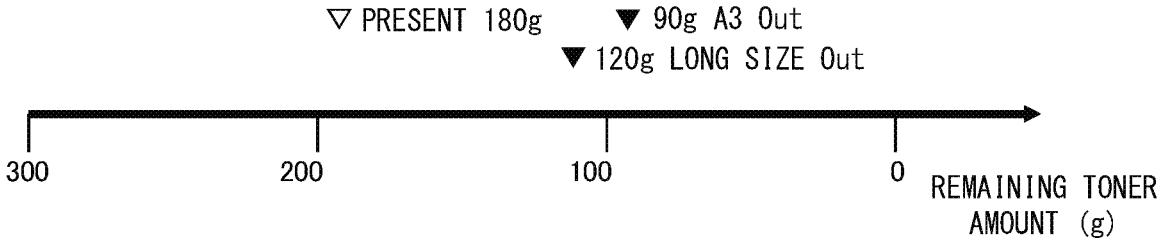
FIG. 11 is a chart indicating a remaining toner amount of No Toner depending on sizes of recording members according to a second embodiment.

As illustrated in FIG. 11, 300 g of the toner 41 is filled in a new cartridge. In the present embodiment, the remaining amount threshold value 553 displaying Out is set at 90 g for the A3-sized sheet and at 120 g for the long-sized sheet from a remaining toner amount that actually causes voids when a solid image is outputted. Suppose here that the present remaining toner amount within the cartridge has come to be 180 g by forming images. Then, the CPU 51 calculates in accordance to the following equation 1 to indicate a remaining toner amount usable for a size of that recording member:

$$\{(\text{remaining toner amount})-(\text{remaining amount threshold value})\}/\{(\text{filled toner amount})-(\text{remaining amount threshold value})\}\times 100\% \quad \text{Eq. 1}$$

If this equation is specifically calculated per size:

$$\{(180\ g)-(90\ g)\}/\{(300\ g)-(90\ g)\}\times 100\%=43\%$$

in the case of A3-sized sheet, and $$\{(180\ g)-(120\ g)\}/\{(300\ g)-(120\ g)\}\times 100\%=33\%$$

in the case of the long-sized sheet.

The present embodiment notifies the user of the remaining toner amount per size of these recording members by displaying on a monitor 57 serving as a display portion of the PC 52 (see FIG. 4) serving as an external device that has specified a print job. That is, the CPU 51 (see FIG. 4) transmits a remaining toner amount usable for the recording media of each size to the PC 52. FIG. 12A illustrates one exemplary display screen of the monitor 57. Sizes of recording members, i.e., media sizes, rates of remaining toner amount in each size and statuses are displayed on the monitor 57. Note that the 'statuses' in FIGS. 12A and 12B are information concerning replacement of the cartridge, such as 'Low!' urging the user to prepare a cartridge to be replaced, 'Out!' urging the user to replace the cartridge and 'OK' indicating that the cartridge is usable.

The user can display this screen by pressing Status button on the display screen of the printer driver of the PC 52 at any timing. Still further, a threshold value of displaying 'Low!' urging to prepare a cartridge is set at 35% in the present embodiment. This threshold value is also stored in the remaining amount threshold value 553. Because the rate of the remaining toner amount of the long-sized sheet is 33% as described above and is smaller than the threshold value of Low, the display of 'Low!' is made in a column of the Status of the long-sized sheet. Still further, when the remaining toner amount becomes 0% or when the remaining toner amount exceeds a threshold value of Out, e.g., 5%, which is lower than the threshold value of Low, the user is urged to replace the cartridge by displaying 'Out!' in the column of the status. In a case where the statuses are not Low and Out, 'OK' is displayed.

Note that while the exemplary display when the toner is one color is illustrated in FIG. 12A in order to simplify the description, the rate of remaining amount and the status are displayed per size of the recording member in each color in a case of an apparatus using four toner colors of YMCK. Still further, as illustrated in FIG. 12A, information indicating that there is no toner within the cartridge, i.e., that the toner within the cartridge is insufficient to form an image on a recording member of that size, and the 'Out!' display which is a display of information concerning replacement of the cartridge, i.e., information indicating that it is necessary to replace the cartridge to form an image on a recording member of that size, are made on the same one screen in the screen of the monitor 57. That is, the information, on respective sizes of recording member, indicating that there is no toner within the cartridge and concerning the replacement of the cartridge are simultaneously displayed. Still further, the display of the rate of remaining amount which is information concerning a remaining developer amount usable for each size of the recording member is also made on the same one screen illustrated in FIG. 12A. Still further, while the rate of remaining amount is illustrated in FIG. 12A, it is also possible to display estimations such as a remaining number of sheets on which images can be formed or a remaining number of days during which images can be formed based on past use history obtained from the history counter 551 and the usage counter 552 (see FIG. 4) per size of the recording member. That is, it is also possible to display a number of usable recording members or a number of usable days per recording member by that cartridge as information concerning replacement of the cartridge.

For instance, FIG. 12B illustrates screens that can be viewed by switching among screens of the A4, A3 and long-sized sheets. In addition to the rate of remaining amount and status, FIG. 12B displays a number of usable recording members, i.e., an estimated remaining number of sheets, and a number of usable days, i.e., an estimated number of remaining days, per recording member by that cartridge. While FIG. 12B displays while switching the screens per size of the recording member, the display may be made on same one screen. Still further, while various size recording members may be displayed, it is more convenient if the display is made by limiting to a size of a recording member set in the image forming apparatus.

According to the present embodiment, it is possible to inform the user of the remaining toner amount, the cartridge preparing or replacing timing as well as the number of usable sheets and the number of usable days. As a result, the user can prepare a replacement cartridge or can replace the cartridge at adequate timing conforming to the size of the recording member used by the user. Still further, the user can adequately grasp a level by which the cartridge should be replaced.

Note that while the case in which the user confirms the status at arbitrary timing has been described in the present embodiment, it is also possible to arrange so as to inform the user by forcibly making a popup display on the monitor 57 when the status becomes low!' or 'Out!'. Thereby, it is possible to prevent the user from missing replacement timing. Still further, the display as described above may be made on the UI 53 of the image forming apparatus.

Other Embodiments

The configuration in which the one-component developer containing non-magnetic toner is used as the developer has been described in the embodiments described above. However, the developer may be one-component developer containing magnetic toner. Note that the one-component developer contains non-magnetic or magnetic toner and external additives and contains no carrier in a two-component developer.

Still further, while the configuration in which toner is supplied to the developing roller 42 by the supply member 43 has been described as the developing unit 4Y serving as the cartridge, the developing unit may have another configuration. For instance, toner may be supplied by a toner supplying roller for supplying toner by contacting with the developer roller 42 or a screw disposed in a vicinity of the developing roller 42 to convey the toner from a front side to a back direction of FIGS. 2A and 2B.

Still further, while the configuration in which the development cartridge is the developing unit has been described in each embodiment described above, the cartridge is not limited to that. That is, the cartridge that displays or transmits that there is no toner, i.e., that the toner within the cartridge is insufficient to form an image on a recording member of a size, or the cartridge that displays or transmits information concerning replacement of the cartridge, i.e., information indicating that it is necessary to replace the cartridge to form an image on a recording member of a size, can be used.

Figure 13:
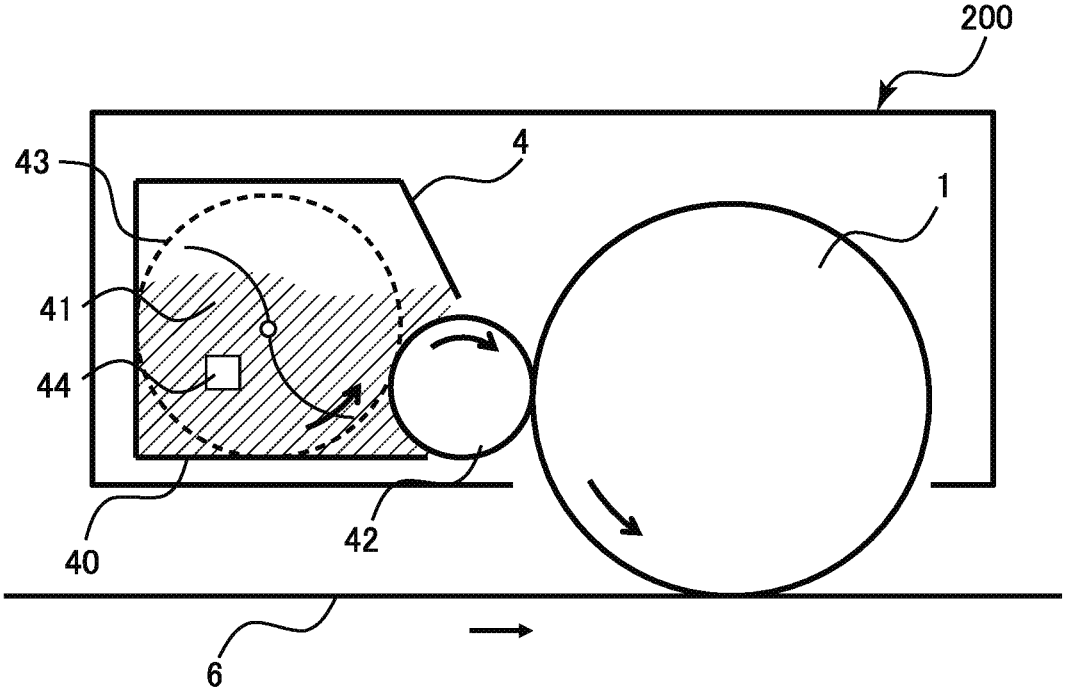
FIG. 13 is a schematic diagram illustrating a configuration of a part of an image forming station according to one example of another embodiment.

For instance, the development cartridge may be a process cartridge 200 containing the photosensitive drum 1 serving as an image bearing member and the developing unit 4 and may be attachable to the apparatus body as illustrated in FIG. 13. The developing unit 4 is the same with the abovementioned developing units 4Y through 4K. While the photosensitive drum 1 is the same with the abovementioned photosensitive drums 1Y through 1K, the process cartridge 200 may include a charging roller and a cleaning unit.

Figure 14:
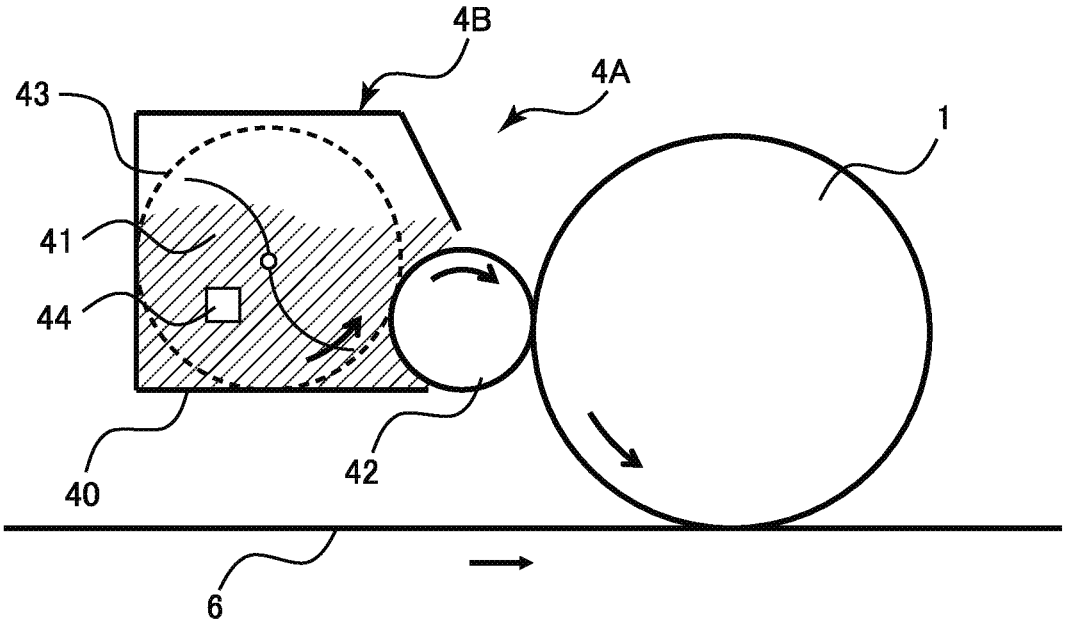
FIG. 14 is a schematic diagram illustrating a configuration of a part of an image forming station according to a second example of the other embodiment.

Still further, as illustrated in FIG. 14, there is a configuration in which the developing unit 4A can be separated into the developing roller 42 and a developer supply unit 4B and only the developer supply unit 4B is attachable to the apparatus body. The developer supply unit 4B includes the storage container 40 and the supply member 43. It is also possible to arrange such configuration so as to display or transmit that there is no toner, i.e., that the toner within the cartridge is insufficient to form an image on a recording member of a size or so as to display or transmit information concerning replacement of the cartridge, i.e., information indicating that it is necessary to replace the cartridge to form an image on a recording member of a size per size of the recording member similarly to each embodiment described above.

The image forming apparatus may be any one of a copier, a printer, a facsimile machine and a multi-function printer having a plurality of such functions.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-107292, filed Jun. 7, 2019, which is hereby incorporated by reference herein in its entirety.

What is claimed is:

1. An image forming apparatus configured to form a toner image on a recording member, comprising:

an image bearing member;

a development cartridge configured to accommodate developer and comprising a developer bearing member bearing and conveying the accommodated developer to a position where an electrostatic latent image formed on the image bearing member is developed;

a detection unit configured to detect an amount of the developer accommodated in the development cartridge; and a display portion configured to, in a case in which the amount of the developer accommodated in the development cartridge detected by the detection unit is insufficient with respect to an amount of the developer for forming the toner image on a recording member of a first size, and is not insufficient with respect to an amount of the developer for forming the toner image on a recording member of a second size smaller than the first size, i) display information indicating that the amount of the developer accommodated in the development cartridge is insufficient to form the toner image on the recording member of the first size, and ii) display information indicating that the amount of the developer accommodated in the development cartridge is not insufficient to form the toner image on the recording member of the second size.

2. The image forming apparatus according to claim 1, further comprising a control portion configured to control an image forming unit including the image bearing member and the development cartridge, wherein the display portion is configured to further display a selection screen for selecting whether or not to continue to form the toner image on the recording member of the first size, and wherein in a case in which to continue to form the toner image on the recording member of the first size is selected in the selection screen, the control portion is configured to control the image forming unit to continue to form the toner image on the recording member of the first size.

3. The image forming apparatus according to claim 1, wherein the display portion is configured to simultaneously display:

the information indicating that the amount of the developer accommodated in the development cartridge is insufficient to form the toner image on the recording member of the first size, and the information indicating that the amount of the developer accommodated in the development cartridge is not insufficient to form the toner image on the recording member of the second size.

4. The image forming apparatus according to claim 1, wherein the display portion is configured to further display:

information concerning a remaining amount of the developer accommodated in the development cartridge based on the amount of the developer accommodated in the development cartridge detected by the detection unit and the amount of the developer for forming the toner image on the recording member of the first size, and information concerning a remaining amount of the developer accommodated in the development cartridge based on the amount of the developer accommodated in the development cartridge detected by the detection unit and the amount of the developer for forming the toner image on the recording member of the second size.

5. The image forming apparatus according to claim 4, wherein the display portion is configured to simultaneously display:

the information concerning the remaining amount of the developer accommodated in the development cartridge based on the amount of the developer accommodated in the development cartridge detected by the detection unit and the amount of the developer for forming the toner image on the recording member of the first size, and the information concerning the remaining amount of the developer accommodated in the development cartridge based on the amount of the developer accommodated in the development cartridge detected by the detection unit and the amount of the developer for forming the toner image on the recording member of the second size.

6. The image forming apparatus according to claim 1, wherein the first size is a long-size.

7. An image forming apparatus configured to communicate with an external device and to form a toner image on a recording member, comprising:

an image bearing member;

a development cartridge configured to accommodate developer and comprising a developer bearing member bearing and conveying the accommodated developer toward a position where an electrostatic latent image formed on the image bearing member is developed;

a detection unit configured to detect an amount of the developer accommodated in the development cartridge; and a transmission portion configured to, in a case in which the amount of the developer accommodated in the development cartridge detected by the detection unit is insufficient with respect to an amount of the developer for forming the toner image on a recording member of a first size, and is not insufficient with respect to an amount of the developer for forming the toner image on a recording member of a second size smaller than the first size, i) transmit information indicating that the amount of the developer accommodated in the development cartridge is insufficient to form the toner image on the recording member of the first size to the external device, and ii) transmit information indicating that the amount of the developer accommodated in the development cartridge is not insufficient to form the toner image on the recording member of the second size to the external device.

8. The image forming apparatus according to claim 7, wherein the transmission portion is configured to further transmit:

information concerning a remaining amount of the developer accommodated in the development cartridge based on the amount of the developer accommodated in the development cartridge detected by the detection unit and the amount of the developer for forming the toner image on the recording member of the first size, and information concerning a remaining amount of the developer accommodated in the development cartridge based on the amount of the developer accommodated in the development cartridge detected by the detection unit and the amount of the developer for forming the toner image on the recording member of the second size.

9. The image forming apparatus according to claim 7, wherein the first size is a long-size.

10. An image forming apparatus configured to form a toner image on a recording member, comprising:

an image bearing member;

a development cartridge configured to accommodate developer and comprising a developer bearing member bearing and conveying the accommodated developer to a position where an electrostatic latent image formed on the image bearing member is developed;

a detection unit configured to detect an amount of the developer accommodated in the development cartridge; and a display portion configured to, in a case in which the amount of the developer accommodated in the development cartridge detected by the detection unit is insufficient with respect to an amount of the developer for forming the toner image on a recording member of a first size, and is not insufficient with respect to an amount of the developer for forming the toner image on a recording member of a second size smaller than the first size, i) display information indicating that it is necessary to replace the development cartridge for forming the toner image on the recording member of the first size, and ii) display information indicating that it is not necessary to replace the development cartridge for forming the toner image on the recording member of the second size.

11. The image forming apparatus according to claim 10, further comprising a control portion configured to control an image forming unit including the image bearing member and the development cartridge, wherein the display portion is configured to further display a selection screen for selecting whether or not to continue to form the toner image on the recording member of the first size, and wherein in a case in which to continue to form the toner image on the recording member of the first size is selected in the selection screen, the control portion controls the image forming unit to continue to form the toner image on the recording member of the first size.

12. The image forming apparatus according to claim 10, wherein the display portion is configured to simultaneously display:

the information indicating that it is necessary to replace the development cartridge for forming the toner image on the recording member of the first size, and the information indicating that it is not necessary to replace the development cartridge for forming the toner image on the recording member of the second size.

13. The image forming apparatus according to claim 10, wherein the display portion is configured to further display:

information concerning a remaining amount of the developer accommodated in the development cartridge based on the amount of the developer accommodated in the development cartridge detected by the detection unit and the amount of the developer for forming the toner image on the recording member of the first size, and information concerning a remaining amount of the developer accommodated in the development cartridge based on the amount of the developer accommodated in the development cartridge detected by the detection unit and the amount of the developer for forming the toner image on the recording member of the second size.

14. The image forming apparatus according to claim 13, wherein the display portion is configured to simultaneously display:

the information concerning the remaining amount of the developer accommodated in the development cartridge based on the amount of the developer accommodated in the development cartridge detected by the detection unit and the amount of the developer for forming the toner image on the recording member of the first size, and the information concerning the remaining amount of the developer accommodated in the development cartridge based on the amount of the developer accommodated in the development cartridge detected by the detection unit and the amount of the developer for forming the toner image on the recording member of the second size.

15. The image forming apparatus according to claim 10, wherein the first size is a long-size.

16. An image forming apparatus configured to communicate with an external device and to form a toner image on a recording member, comprising:

an image bearing member;

a development cartridge configured to accommodate developer and comprising a developer bearing member bearing and conveying the accommodated developer to a position where an electrostatic latent image formed on the image bearing member is developed;

a detection unit configured to detect an amount of the developer accommodated in the development cartridge; and a transmission portion configured to, in a case in which the amount of the developer accommodated in the development cartridge detected by the detection unit is insufficient with respect to an amount of the developer for forming the toner image on a recording member of a first size, and is not insufficient with respect to an amount of the developer for forming the toner image on a recording member of a second size smaller than the first size, i) transmit information indicating that it is necessary to replace the development cartridge for forming the toner image on the recording member of the first size to the external device, and ii) transmit information indicating that it is not necessary to replace the development cartridge for forming the toner image on the recording member of the second size to the external device.

17. The image forming apparatus according to claim 16, wherein the transmission portion is configured to further transmit:

information concerning a remaining amount of the developer accommodated in the development cartridge based on the amount of the developer accommodated in the development cartridge detected by the detection unit and the amount of the developer for forming the toner image on the recording member of the first size, and information concerning a remaining amount of the developer accommodated in the development cartridge based on the amount of the developer accommodated in the development cartridge detected by the detection unit and the amount of the developer for forming the toner image on the recording member of the second size.

18. The image forming apparatus according to claim 16, wherein the first size is a long-size.

* * * * *